US009546798B2

(12) United States Patent
Deivasigamani et al.

(10) Patent No.: US 9,546,798 B2
(45) Date of Patent: Jan. 17, 2017

(54) COMBINED GAS-WATER TUBE HYBRID HEAT EXCHANGER

(75) Inventors: Sridhar Deivasigamani, Peoria, IL (US); Sivaprasad Akasam, Peoria, IL (US)

(73) Assignee: Intellihot Green Technologies, Inc., Galesburg, IL (US)

( * ) Notice: Subject to any disclaimer, the term of this patent is extended or adjusted under 35 U.S.C. 154(b) by 337 days.

(21) Appl. No.: 14/347,272

(22) PCT Filed: Jul. 31, 2012

(86) PCT No.: PCT/US2012/048970

§ 371 (c)(1),
(2), (4) Date: Jul. 11, 2014

(87) PCT Pub. No.: WO2013/055431

PCT Pub. Date: Apr. 18, 2013

(65) Prior Publication Data

US 2014/0326197 A1 Nov. 6, 2014

Related U.S. Application Data

(60) Provisional application No. 61/545,385, filed on Oct. 10, 2011.

(51) Int. Cl.
*F28D 7/16* (2006.01)
*F24H 1/14* (2006.01)
(Continued)

(52) U.S. Cl.
CPC ..... *F24H 1/145* (2013.01); *F24H 1/285* (2013.01); *F24H 1/287* (2013.01); *F24H 1/44* (2013.01);
(Continued)

(58) Field of Classification Search
USPC ..... 122/8, 9, 13.01, 15.1, 17.1, 18.1, 18.3, 122/18.31, 235.11, 235.15, 235.32, 122/367.1, 367.2; 126/101, 359.1; 165/47, 165/48.1, 100, 110, 111, 128, 129, 130, 165/131, 132, 139, 143, 144, 145, 154, 165/157, 158, 164, 165, 172, 173, 175
See application file for complete search history.

(56) References Cited

U.S. PATENT DOCUMENTS 3,526,211 A * 9/1970 Corey ..... F24H 1/186 122/14.1
4,056,143 A * 11/1977 Martin ..... F24H 1/403 122/338
(Continued)

OTHER PUBLICATIONS

PCT/US2012/048970 The International Search Report and The Written Opinion of the International Searching Authority.
(Continued)

*Primary Examiner* — Gregory A Wilson
(74) *Attorney, Agent, or Firm* — Tracy Jong Law Firm; Tracy P. Jong; Cheng Ning Jong

(57) ABSTRACT

A heat exchanger having a cylindrical body comprising an upper section, a lower section, a side water jacket surrounding the upper and lower sections, a top water jacket disposed atop the upper section and a gas exhaust disposed below the lower section. A water cavity is disposed substantially in the lower section while a gas cavity having a burner is disposed substantially centrally within the gas cavity. A plurality of water tubes disposed in a ring formation, connect the water cavity through the gas cavity to the top water jacket and a plurality of gas tubes also disposed in ring formations, connect the gas cavity through the water cavity to the gas exhaust. At least one of the gas tubes ring has a diameter that is greater than that of the water tubes ring.

19 Claims, 13 Drawing Sheets

(51) Int. Cl.

| | |
|---|---|
| ***F28D 7/00*** | (2006.01) |
| ***F24H 1/28*** | (2006.01) |
| ***F24H 1/44*** | (2006.01) |
| ***F24H 9/00*** | (2006.01) |

(52) U.S. Cl.
CPC ..... *F24H 9/0026* (2013.01); *F28D 7/0075* (2013.01); *F28D 7/16* (2013.01); *F28D 7/1676* (2013.01)

(56) References Cited

U.S. PATENT DOCUMENTS 4,157,706 A * 6/1979 Gaskill ..... F28D 21/0007 122/155.2
4,444,155 A * 4/1984 Charron ..... F24H 1/403 122/155.1
4,632,066 A * 12/1986 Kideys ..... F24H 1/205 122/18.2
4,651,714 A * 3/1987 Granberg ..... F23D 14/12 122/149
RE33,082 E * 10/1989 Gerstmann ..... F24D 11/004 122/20 B
5,613,553 A * 3/1997 Hong ..... F24H 1/30 122/209.1
6,076,518 A * 6/2000 Klouda ..... F22B 13/005 122/158
7,614,366 B2 * 11/2009 Arnold ..... F24H 1/206 122/18.1
7,823,544 B2 * 11/2010 Christie ..... F22B 9/10 122/18.1
8,074,610 B2 * 12/2011 Kim ..... F24D 12/02 122/15.1
8,375,898 B2 * 2/2013 Min ..... F24H 1/16 122/18.1
2007/0209606 A1 * 9/2007 Hamada ..... F24H 1/43 122/18.1
2009/0050077 A1 * 2/2009 Kim ..... F24D 12/02 122/15.1
2009/0308568 A1 * 12/2009 Min ..... F24H 9/0036 165/47

OTHER PUBLICATIONS

PCT/US2012/048970 The International Preliminary Report on Patentability.

* cited by examiner

COMBINED GAS-WATER TUBE HYBRID HEAT EXCHANGER

PRIORITY CLAIM AND RELATED APPLICATIONS

This application claims the benefit of priority from U.S. Ser. No. 61/545,385; a U.S. provisional application filed on Oct. 10, 2011 and PCT/US2012/048970, a PCT application filed Jul. 31, 2012. Each of said applications is incorporated by reference herein in its entirety.

BACKGROUND OF THE INVENTION

1. The Field of the Invention

The present invention is directed generally to a heat exchanger. More specifically, the present invention is directed to a combined gas and water tube heat exchanger for use with a hot water heater.

2. Background Art

Fin-and-tube heat exchangers of conventional hot water systems often include a helical coil tube having fins disposed on external surfaces of the coil tube. Ceramic discs may be utilized to insulate direct heat of a burner from its adjacent components, such as a fan blower and other components disposed at the exhaust of a heat exchanger housing the burner. Typically, a fin-and-tube heat exchanger comprises a generally cylindrical housing, a helix coil tube disposed concentrically inside the housing, a radial-fired burner disposed inside the coil lumen on one end of the helix coil and a ceramic disc disposed inside the helix coil lumen on the opposite end of the helix coil. Typically a top casting fixedly disposed on top of the housing serves as an interface between a fan blower which forces an air/fuel mixture flow to the burner and the burner. The ceramic disc serves as a barrier to shield hot flue gas from damaging components in its path and to channel hot flue gas to more effectively surround the helix coil external surfaces to improve heat transfer from flue gas to the water flowing inside the helix coil.

However, the use of a ceramic disc inside the lumen takes up valuable heat exchanger footprint, increases fabrication and installation costs and fails to harness and recover the maximum amount of energy. In such installations, typically fluid baffle plates are used and positioned between coil windings (loops) such that hot flue gas can be more efficiently directed around coil tube. Though effective in enhancing heat transfer from the hot flue gas to the helix coil, there remain gaps in the path of the hot flue gas to escape through. Poor heat recovery through the top casting further causes an unnecessarily warm top casting, waste to the environment and unnecessarily heats up surrounding components. The construction of fin-and-tube further requires specialized tools to carry out multiple steps involving bending of a tube to create a coil tube and sliding and welding numerous fins over the coil tube to create a good contact of the fins over the coil tube to encourage heat transfer. Significant heat loss also occurs through the heat exchanger housing.

Current heat exchanger designs require insulations on the outer shell of a heat exchanger to prevent heat loss from the heat exchanger to contain heat that would otherwise be lost to the surroundings.

Thus, there arises a need for a heat exchanger capable of harnessing the otherwise damaging or lost heat from the burner and a heat exchanger that is simple and cost effective to fabricate. Further, there is a need to improve the efficiency of a heat exchanger without increasing parts count and the complexity of a heat exchanger.

SUMMARY OF THE INVENTION

The present invention is directed toward a heat exchanger comprising combined water and gas tubes, the heat exchanger is buildable with simpler and less costly construction techniques as compared to conventional gas-fired water tube heat exchangers. The present heat exchanger includes an cylindrical body including an upper section, a lower section, a side water jacket having a water outlet and surrounding the upper section and the lower section, a top water jacket disposed atop the upper section and a gas exhaust disposed below the lower section, wherein the water outlet is disposed substantially at the lower end of the side water jacket. The heat exchanger comprises a water cavity having a water inlet for receiving water, wherein the water inlet is disposed substantially at the lower end of the lower section and the water cavity is disposed substantially in the lower section, a gas cavity having a burner is disposed substantially centrally within the gas cavity, a plurality of water tubes connecting the water cavity through the gas cavity to the top water jacket and a plurality of gas tubes connecting the gas cavity through the water cavity to the gas exhaust. A number of the plurality of gas tubes are disposed at a greater radial distance from the burner than the radial distance between each of the plurality of water tubes and the burner. A water flow is configured to occur from the water inlet through the water cavity, the water tubes, the top water jacket and the side water jacket to the water outlet and the burner is configured to produce direct heat and a flue gas flow which flows from the gas cavity through the gas tubes to the exhaust and heat transfer is caused from the direct heat and the flue gas flow to the water flow. In one embodiment, each of the gas and water tubes further comprises a turbulator disposed substantially over its entire length.

Accordingly, it is a primary object of the present invention to provide a heat exchanger buildable with simpler and less costly construction techniques as compared to conventional gas-fired water tube heat exchangers.

It is a further object of the present invention to eliminate delays in providing hot water to a hot water user.

It is yet a further object of the present invention to minimize thermal losses of a heat exchanger to its surrounding and maximize heat recovery. The side and top water jackets minimize heat loss due primarily to convection to the air and heat exchanger components surrounding the heat exchanger by causing heat transfer to the water flow within the top and side jackets instead of the heat exchanger surroundings.

Conventionally, ceramic discs serve as a barrier to shield hot flue gas from damaging components in its path and to channel hot flue gas to more effectively surround the helix coil external surfaces to improve heat transfer from flue gas to the water flowing inside the helix coil. It is another object of the present invention to eliminate the use of ceramic components by strategically disposing the present water flow paths to alleviate excessive heat build-up in any components.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
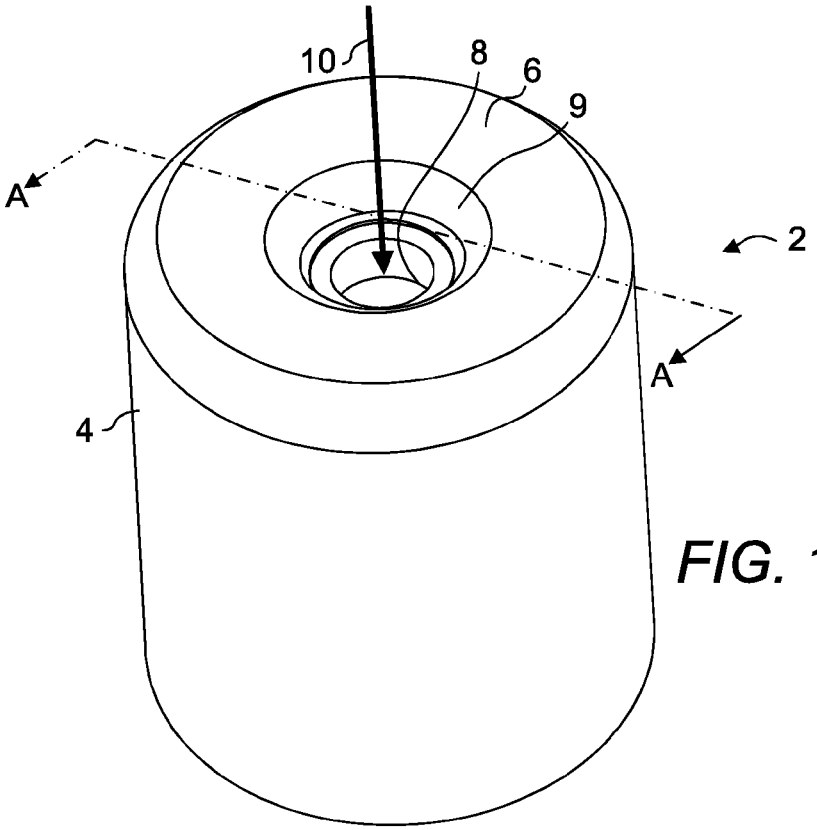
FIG. 1 is a top perspective view of a heat exchanger of the present invention, depicting a cavity for receiving air/fuel mixture through the top surface of the heat exchanger.

2—heat exchanger
4—side water jacket
6—top water jacket
8—burner
9—opening
10—direction of air/fuel mixture flow
12—flue gas flow
14—water flow
16—turbulator
18—water tube
20—gas tube
22—water inlet
24—water outlet
26—flue gas exhaust
28—blower
30—cold water inlet
32—hot water outlet
34—pump
36—main flowline
38—solenoid valve
40—check valve
42—main flow
44—recirculation flow
46—top tube sheet
48—middle tube sheet
50—bottom tube sheet
52—aperture for receiving burner
54—apertures for receiving water tubes
56—apertures for receiving gas tubes
58—apertures for connecting side and top water jackets
60—upper section
62—lower section
64—internal recirculation flowline
66—gas cavity
68—water cavity
70—inner manifold
72—outer manifold
74—slot on gas tube
76—aperture connecting water cavity and side water jacket
78—water tube on inner ring
80—water tube on outer ring
82—outer tube
84—inner wall of side liquid jacket
86—inner ring
88—outer ring
90—flow between water tubes within a ring
92—flow between water tubes of inner and outer rings
94—interior surface of top water jacket
96—interior surface of side water jacket

PARTICULAR ADVANTAGES OF THE INVENTION

Heat transfer between two parts is proportional to the thermal gradient (differential) between the two parts. The higher this gradient, there is a higher tendency for heat to be transferred from the warmer part to the cooler part. The present invention utilizes this principal to cause relatively high thermal gradient throughout the majority of the flow paths within the heat exchanger. Existing fin-and tube coils require costly finned tubes to increase surface area in order to compensate for the lower heat transfer coefficient of hot gases as there is only one water flow path in a helical coil tube. Heat flux or thermal flux is defined as the rate of heat energy transfer through a given surface. In the present invention, heat flux from the burner to the water flow is maintained at a high level by providing multiple flow paths which are exposed to a burner or its flue gas.

Heat flux is further maintained by creating turbulence within the water tubes and within the gas tubes to encourage high heat transfer from the burner to the water flow.

In the present invention, a water jacket is used to enclose the burner on the side and on the top of the heat exchanger. As such, the use of ceramic discs can be eliminated, thereby producing equipment procurement and operating cost savings and reducing environmental wastes as heat generated by the burner is transferred to the water flow and not dissipated and wasted to the surroundings of the heat exchanger. As a result, the power rating of the burner may also be reduced and the overall thermal efficiency of the heat exchanger is increased as the power required to heat a flow is now lower. The fabrication cost of the present heat exchanger is reduced as compared to prior art heat exchangers. The functional design of the present heat exchanger allows reuse of many components. For instance, the gas and water tubes share the same design and few fabricating steps are applied as the design involves simple elemental components, i.e., straight tubes cut to length or tube sheets stamped with apertures. In addition, incorporating turbulators is also a simple matter as turbulators formed in suitable lengths are simply placed in the lumen of gas or water tubes during manufacturing. Reuse is again possible with turbulators as the same type of turbulators can be used in both gas and water tubes. Further, the tube sheets capping the spans of gas and water tubes are simply formed from a sheet having apertures punched out or otherwise formed to receive gas and water tubes. In a conventional finned tube design, fins are welded onto a helical coil tube to promote heat transfer from the burner to the water flow inside the tube. The total length of the resulting weld joint is tremendous as each fin must be welded to promote heat transfer. The weld joints present tremendous opportunities for corrosion and hence the weakening of the coil tube. In contrast, prior art fire tubes as used in conventional boilers include costly elliptical tubes which are required to be welded to tube sheets. In another embodiment, twisted tubes may be formed by twisting straight tubes to substitute straight tubes to increase turbulence of either in a flue gas or water flow to enhance heat transfer. In yet another embodiment, turbulators are first disposed within straight tubes prior to twisting the straight tubes-turbulators combinations.

The present heat exchanger with a small storage of from about 2 to 20 gallons or 7.6 to 76 liters, can take advantage of a lower BTU burner (up to 85,000 BTU/hr or 25 kW) that can be supported by existing and typical ½-inch (12.7 mm) gas lines, yet has a high heat transfer rate and efficiency, similar to a heat exchanger utilized in a tankless water heater so that a continuous demand of 2.0 gallons per hour (GPH) or 7.6 liters per hour with 70 degrees Fahrenheit (21 degrees Celsius) rise can be met.

Excessive heat build-up can cause thermal stresses especially at joints between tube sheets and water tubes or water jackets, resulting in breakage of flow paths causing leaks. In some embodiments of the present heat exchanger, excessive heat build-up is alleviated by increasing speed and turbulence in the flow through water tubes, especially ones disposed closest to the burner, thereby causing a higher rate of heat transfer from the water tubes to the flow.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

FIG. 1 is a top perspective view of a heat exchanger 2 of the present invention, depicting a cavity for receiving air/fuel mixture through the top surface of the heat exchanger 2. In use, an air/fuel mixture flow is provided in direction 10 to the burner 8 with the aid of a blower 28 (see FIG. 11). The external surfaces of the heat exchanger generally define an elongated cylindrical shaped body having a side water jacket 4, a top water jacket 6 and an opening 9 in the top water jacket 6.

Figure 2:
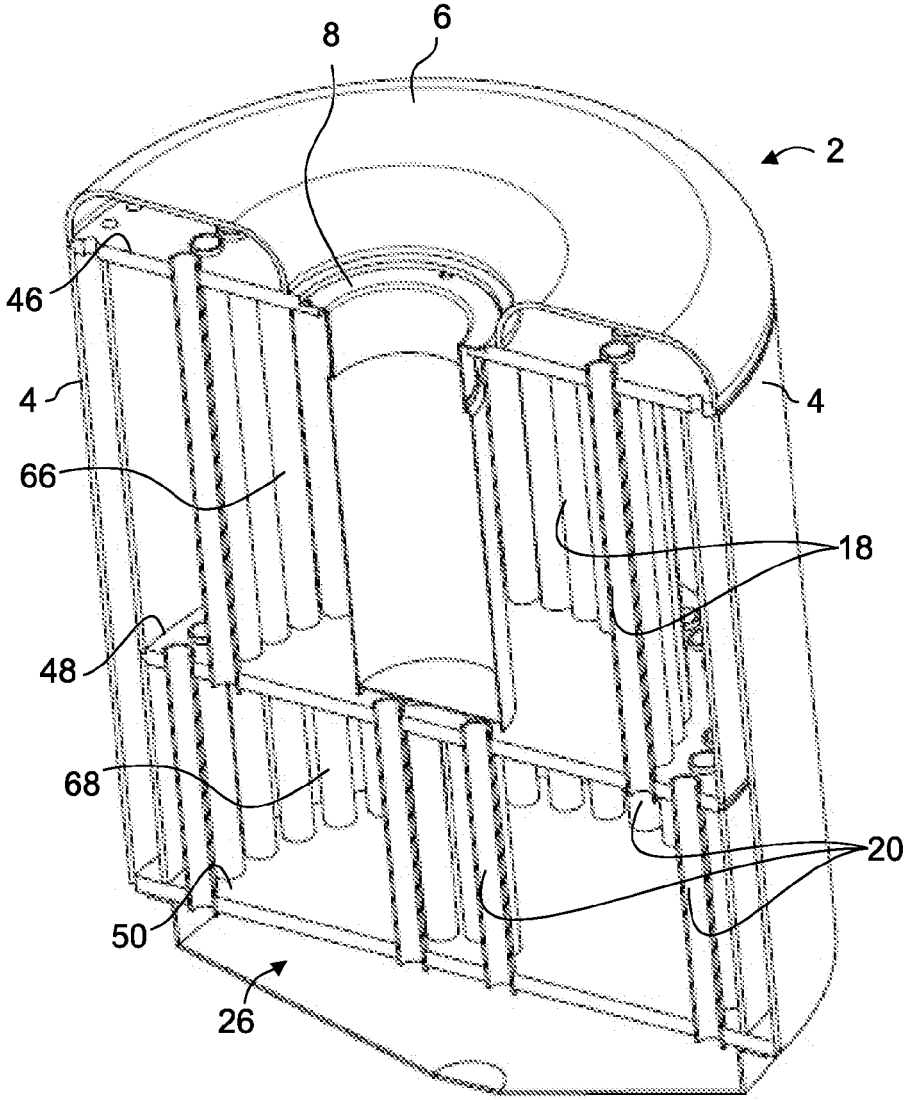
FIG. 2 is a top perspective sectional view as taken along line AA of FIG. 1, depicting internal structures of the heat exchanger which enable incoming cold water to be heated.
Figure 3:
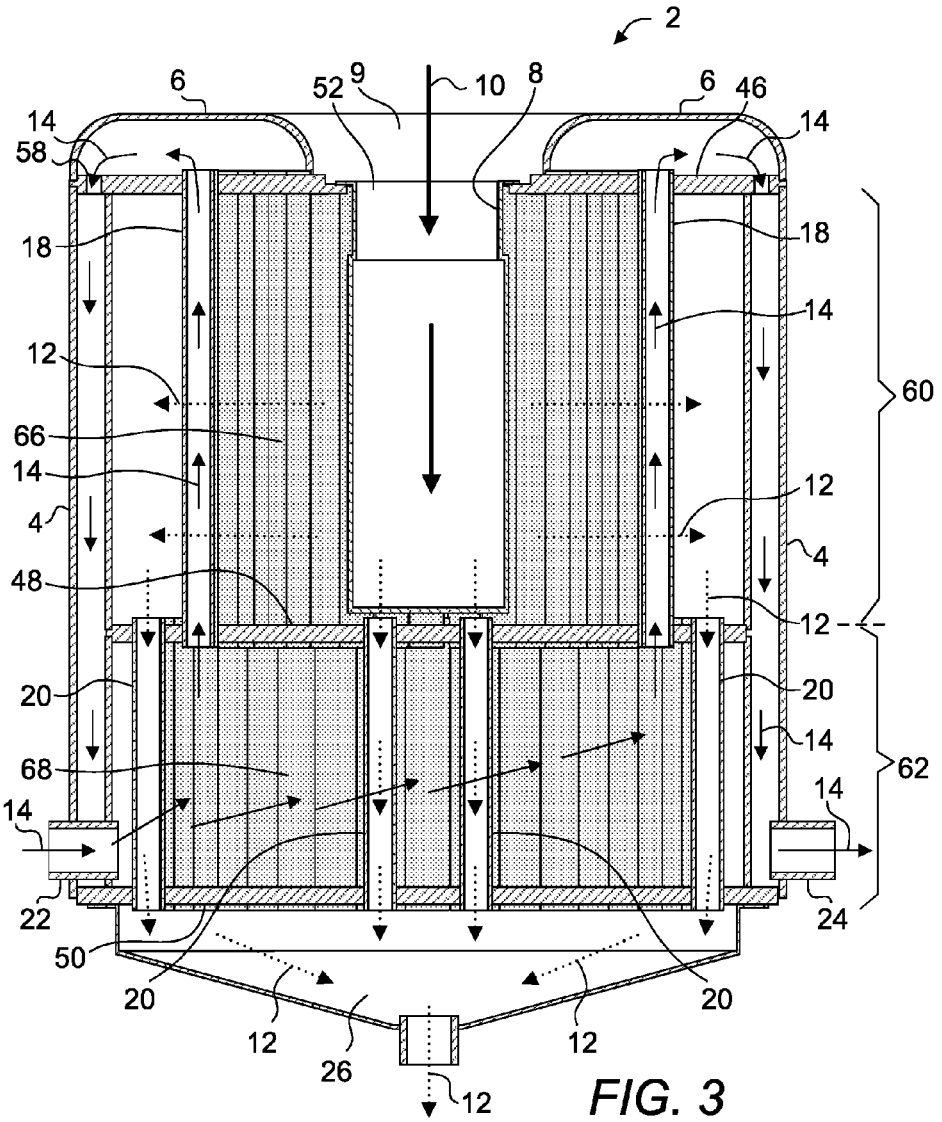
FIG. 3 is a front orthogonal sectional view as taken along line AA of FIG. 1, depicting water and gas flows within the internal structures of the heat exchanger.
Figure 4:
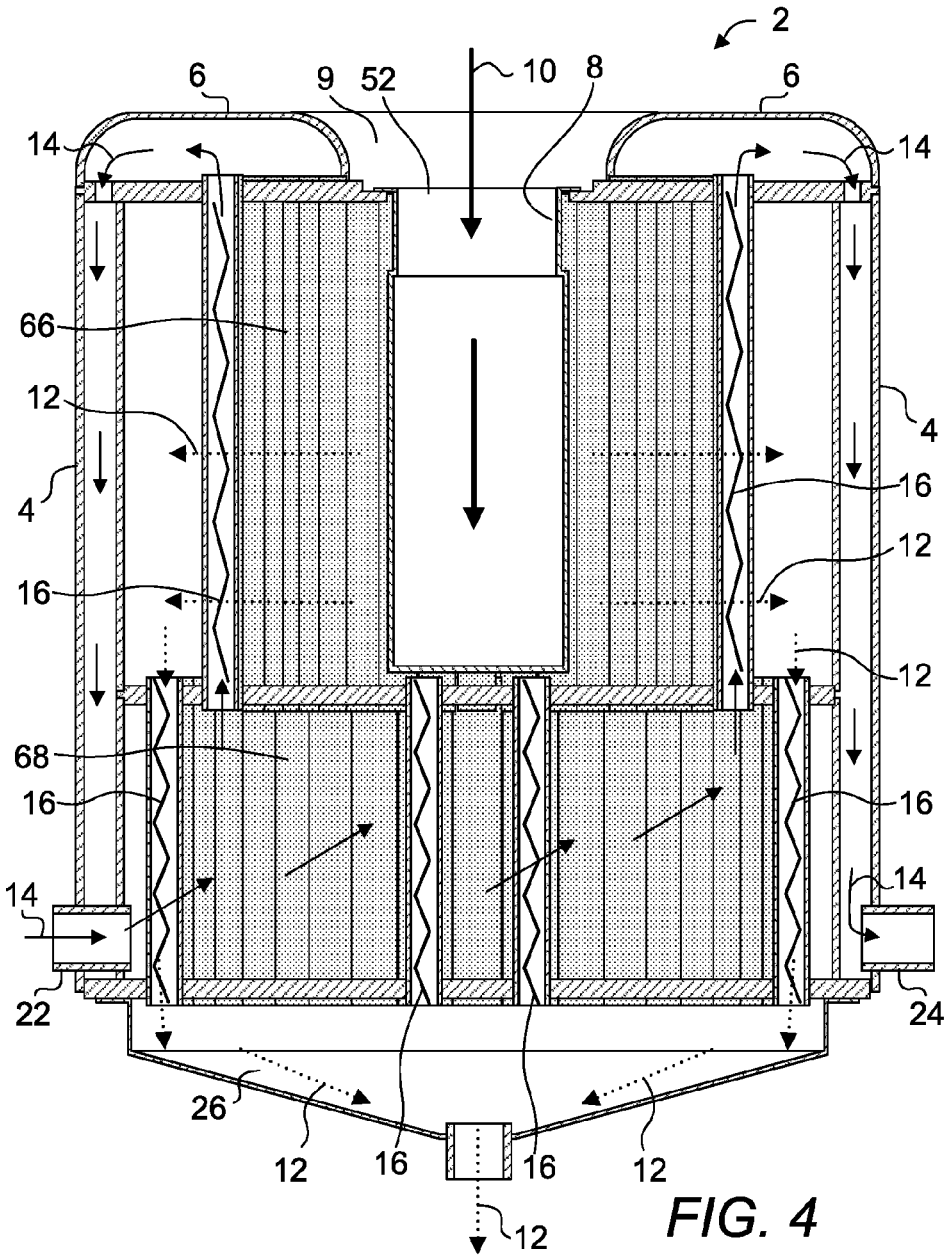
FIG. 4 is a front orthogonal sectional view as depicted in FIG. 3, with the exception that turbulators are used within gas and water tubes.

FIG. 2 is a top perspective sectional view as taken along line AA of FIG. 1, depicting internal structures of the heat exchanger 2 which enable incoming cold water to be heated. FIG. 3 is a front orthogonal sectional view as taken along line AA of FIG. 1 depicting water and gas flows within the internal structures of the heat exchanger 2. FIG. 4 is a front orthogonal sectional view as depicted in FIG. 3 with the exception that turbulators 16 are used within gas and water tubes. The heat exchanger 2 comprises a cylindrical body including an upper section, a lower section, a side water jacket 4 having a water outlet 24, a top water jacket 6 disposed atop the upper section 60 and a flue gas exhaust 26 disposed below the lower section 62. The side water jacket 4 surrounds the upper section 60 and the lower section 62. The water outlet 24 is disposed substantially at the lower end of the side water jacket 4. A water cavity 68 having a water inlet 22 for receiving water is disposed substantially at the lower end of the lower section 62. A gas cavity 66 having a centrally positioned burner 8 is disposed in the upper section 60. A plurality of water tubes 18 connect the water cavity 68 through the gas cavity 66 to the top water jacket 6. A plurality of gas tubes 20 connect the gas cavity 66 through the water cavity 68 to the flue gas exhaust 26, wherein a number of the plurality of gas tubes are disposed at a greater radial distance from the burner 8 than the radial distance between each of the plurality of water tubes 18 and the burner 8 to force the hot flue gas to surround the water tubes 18 on its path to the flue gas exhaust 26.

For a pure on demand (tankless) system with a small storage, the total water volume, i.e., the volumes of water in fluid connectors, top and side water jackets 6, 4 and the water cavity 68 in the lower section is less than 2 gallons (7.6 liters). For more cyclical loads or to meet bulk demands, the water cavity 68 can be expanded to have an increased capacity of, e.g., 20 gallons (76 liters). In one embodiment, each gas or water tube possesses an inside diameter of about 4.8 mm and outside diameter of about 6 mm.

A water flow is configured to flow from the water inlet 22 through the lower section 62, the water tubes 18, the top water jacket 6 and the side water jacket 4 to the water outlet 24. The burner 8 is configured to produce direct heat via convection and radiation and a flue gas flow 12 which flows from the gas cavity 66 through the gas tubes 20 to the gas exhaust 26 and heat transfer is caused from the direct heat and the flue gas flow 12 to the water flow 14. In one embodiment, each gas or water tube further comprises a turbulator disposed substantially over its entire length. When disposed in a water tube 18, a turbulator 16 promotes turbulence in the water flow 14 and increases water flowrate, thereby eliminating localized boiling which can develop on the interior surface of the water tube 18. Localized boiling ultimately causes pitting on the interior surface of the water tube 18. A similar effect is achieved by disposing turbulators 16 in gas tubes 20. Heat transfer from the flue gas per unit flue gas mass flowrate is increased as the rate at which gas particles impinge on the interior surface of the gas tubes increases with the presence of turbulators 16.

Figure 5:
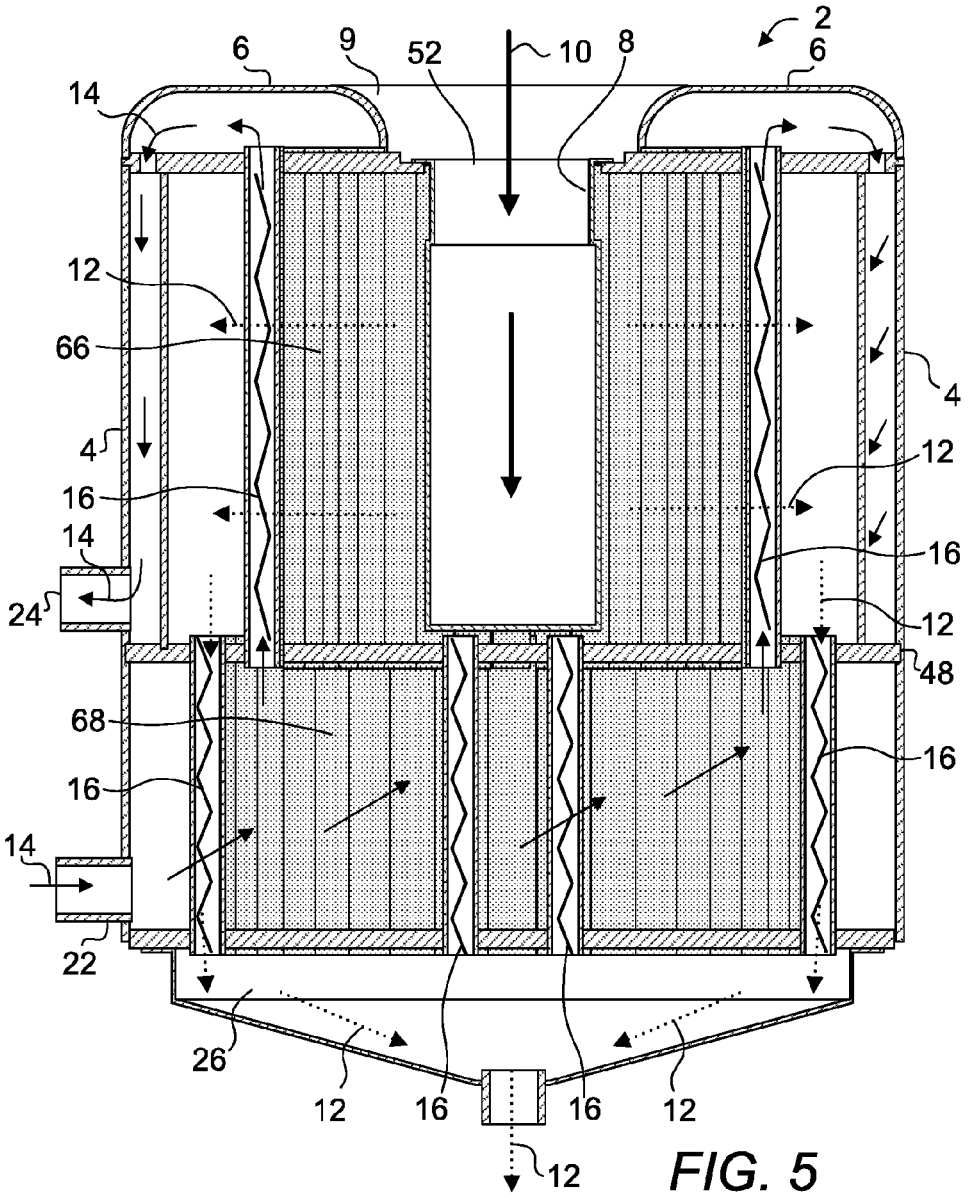
FIG. 5 is a front orthogonal sectional view of another embodiment of the present heat exchanger.

FIG. 5 is a front orthogonal sectional view of another embodiment of the present heat exchanger. In this embodiment, the side water jacket 4 connects the top water jacket 6 at about the top tube sheet 46 and terminates at about the middle tube sheet 48. The outer portion of the lower section essentially constitute a part of the water cavity 68, filled with inlet water, further reducing potential heat loss through the outer portion of the lower section as it is filled predominantly with pre-heat treated incoming water.

Figure 6:
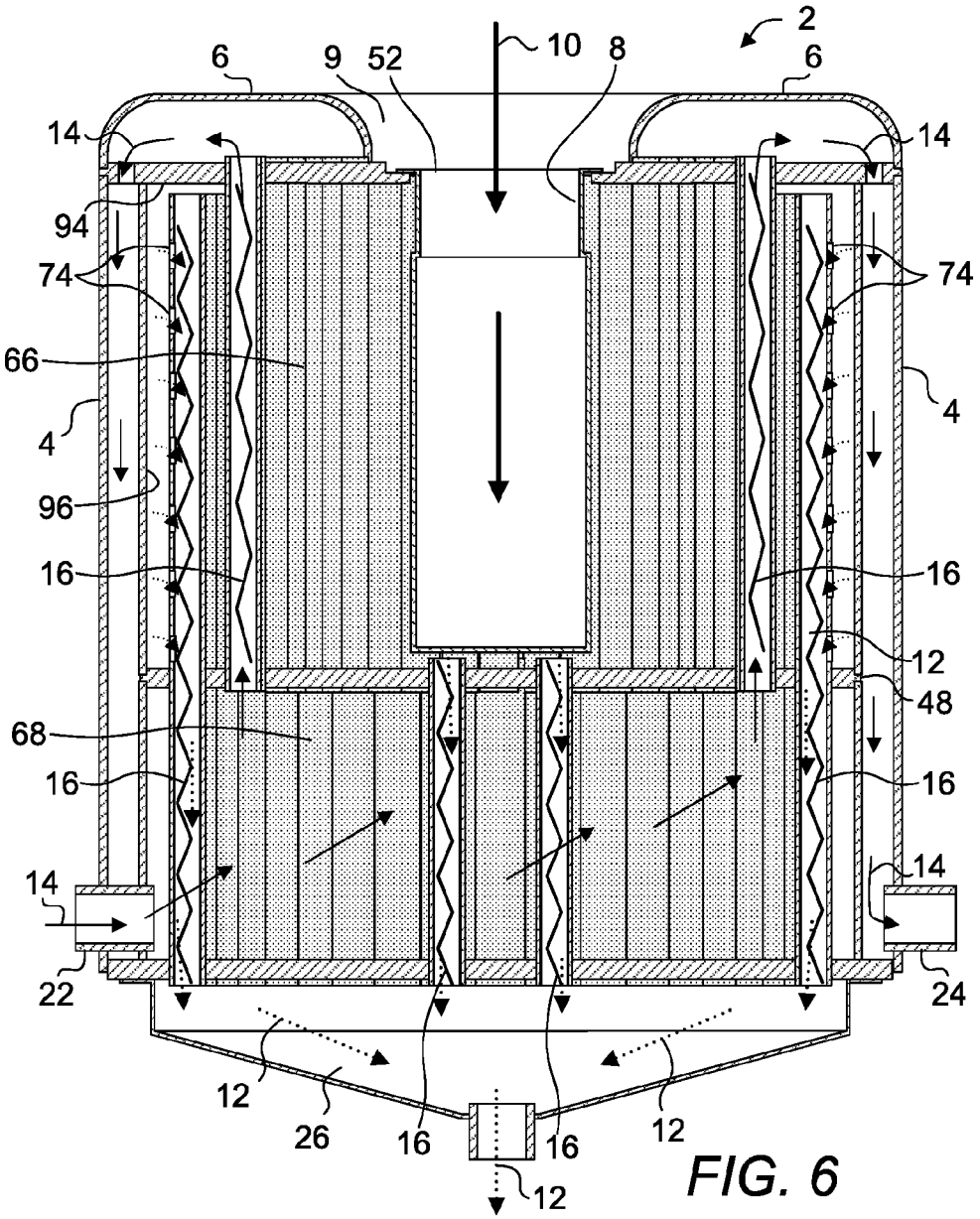
FIG. 6 is a front orthogonal sectional view of yet another embodiment of the present heat exchanger.
Figure 7:
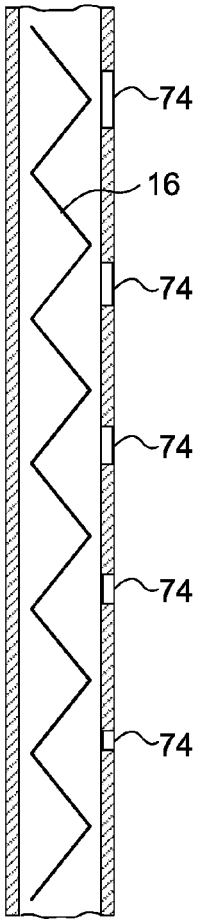
FIG. 7 is a partial orthogonal sectional view of a gas tube of FIG. 6, but depicting the use of progressively smaller gas entry slots as the gas tube approaches the middle tube sheet.

FIG. 6 is a front orthogonal sectional view of yet another embodiment of the present heat exchanger. In this embodiment, the gas tubes 20 are extended past the middle tube sheet 48 and possess gas entry slots 74 disposed in a direction away from the burner 8 so that the hot gases generated by the burner 8 will have to flow around the water tubes 18 or impinge on the interior surfaces 94, 96 of the top and side water jackets 6, 4. FIG. 7 is a partial orthogonal sectional view of a gas tube 20 of FIG. 6, but depicting the use of progressively smaller gas entry slots 74 as the gas tube 20 approaches the flue gas exhaust 26. As hot gases tend to enter the gas tubes 20 at a location closest to the flue gas exhaust 26, the progressively smaller gas entry slots 74 arrangement increases the uniformity of the flue gas flowrate along the lengths of the gas tube 20, thereby increasing the uniformity of heat transfer rate from the burner 8 to water flow 14.

Figure 8:
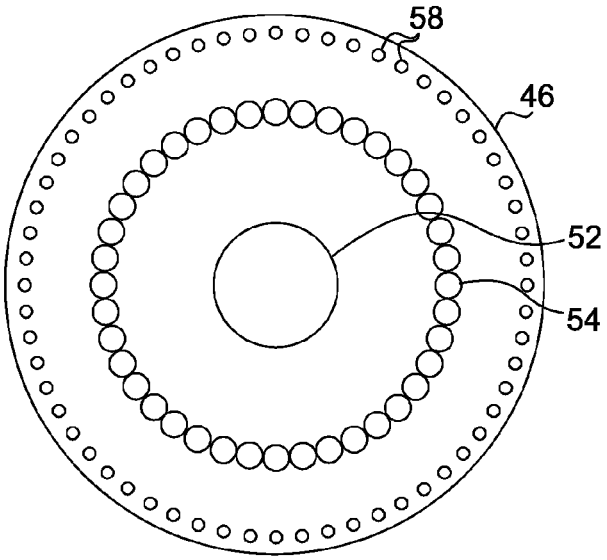
FIGS. 8-10 depict the various tube sheets being used in cooperation with gas and water tubes for constructing the present invention.
Figure 9:
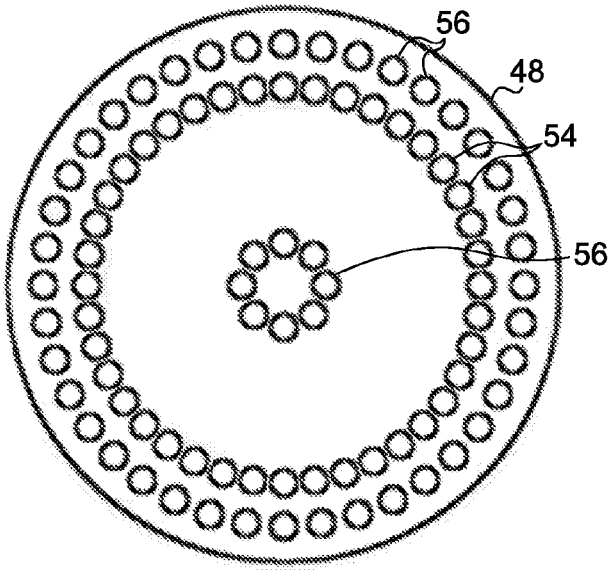
Figure 10:
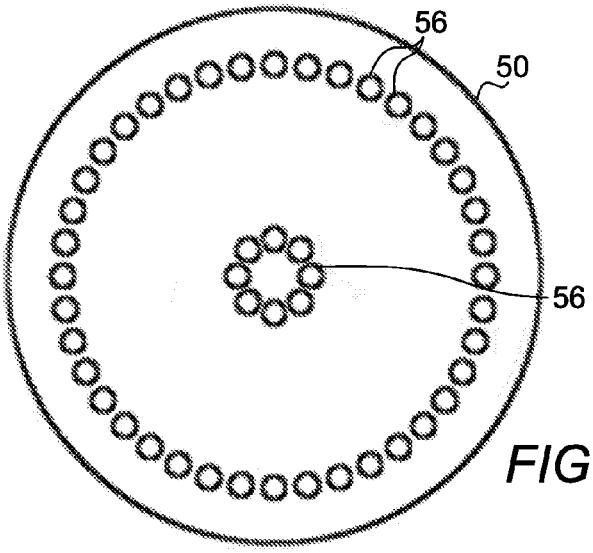

FIGS. 8-10 depict the various tube sheets 46, 48 and 50 being used in cooperation with gas and water tubes 20, 18 for constructing the present invention. The top 46, middle 48 and bottom 50 tube sheets are generally circular. On the top tube sheet 46, a ring of apertures 58 is disposed at about the periphery of the top tube sheet 46 for connecting the side and top water jackets 4, 6. A large aperture 52 is centrally disposed to receive the burner 8. Another ring of apertures 54 for receiving water tubes 18 is disposed around the large aperture 52. On the middle tube sheet 48, a ring of apertures 56 is disposed near the periphery while another ring of apertures 56 is disposed about the center of the middle tube sheet 48. Apertures 56 are configured for receiving gas tubes 20. Yet another ring of apertures 54 is disposed between the two rings of apertures 56. On the bottom tube sheet 50, a ring of apertures 56 is disposed near its periphery while another ring of apertures 56 is disposed about the center of the bottom tube sheet 50. During assembly, the top tube sheet 46 is positioned on top of the middle tube sheet 48 while the middle tube sheet 48 is positioned on top of the bottom tube sheet 50. Apertures 54 of the top tube sheet 46 are substantially vertically aligned with apertures 54 of the middle tube sheet 48. Apertures 56 of the middle tube sheet 48 are substantially vertically aligned with apertures 56 of the bottom tube sheet 50. Water tubes 18 are disposed between the top 46 and middle 48 tube sheets such that one end of each water tube 18 engages an aperture 54 of the top tube sheet 46 while the other end engages an aperture 54 of the middle tube sheet 48. Gas tubes 20 are disposed between the middle 48 and bottom 50 tube sheets such that one end of each gas tube 20 engages an aperture 56 of the middle tube sheet 48 while the other end engages an aperture 56 of the bottom tube sheet 50. In one embodiment, each end of a gas or water tube is roller expanded into an aperture, creating a leakless engagement between a gas 20 or water 18 tube and its corresponding aperture. In another embodiment, each end of a gas or water tube 20, 18 is brazed onto an aperture 54, 56. In these embodiments, the heat exchanger structural integrity is improved or maintained as welding, which increases tendency of joints to corrode, can be avoided. In an embodiment not depicted, a second or outer ring of larger water tubes is disposed around the present ring of water tubes 18. The second ring of water tubes can be angularly indexed with respect to the present water tubes 18 so that the each water tube of the outer ring is disposed in between two consecutive water tubes 18 of the inner ring of water tubes 18. Such configuration further encourages heat transfer to the water flow 14 in the water tubes 18 as the surface area for heat transfer is increased.

The fire tubes (water surrounds hot gases flowing in tubes) or water tubes (hot gases surround water flowing in tubes) of conventional boilers are typically constructed from costly stainless steel to prevent corrosion. In contrast, due to its simplicity in design, the gas and water tubes of the present heat exchanger may be constructed from mild steel and glass coated. This process prevents corrosion at a significantly lower cost.

A pure fire tube configuration, i.e., a configuration which lacks water tubes to remove a portion of the heat generated by a burner prior to the hot gases arriving at the fire tubes, localized boiling tends to occur in on a tube sheet exposed to the burner and the external surface of the fire tubes contacting a volume of water in the water cavity. Localized boiling is a sign of high heat fluxes and high thermal stress that are caused in the fire tubes and the tube sheet when the hot flue gas impinges on them.

Figure 11:
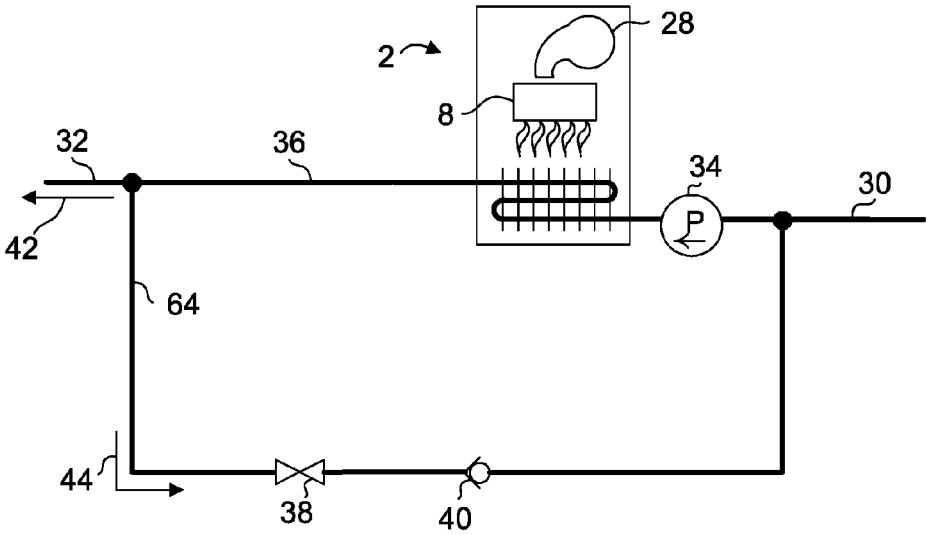
FIG. 11 depicts an exemplary water heating circuit where the present heat exchanger can be utilized.

FIG. 11 depicts an exemplary water heating circuit where the present heat exchanger 2 can be utilized. Cold water enters the water heating circuit through the cold water inlet 30 and exits as heated or hot water through the hot water outlet 32. The water heating circuit depicts a water heating circuit includes an internal recirculation loop 64 which aids in reducing delays in providing hot water to a user at the hot water outlet 32. When a demand exists at the water outlet 32, a main flow 42 is generated in the main flowline 36. Cold water enters the heat exchanger 2, flows through a pump 34, absorbs heat generated by the burner 8, exits the heat exchanger 2 and arrives at the water outlet 32. If an internal recirculation flow 44 is desired in the internal recirculation flowline 64, a solenoid valve 38 disposed in this flowline is opened and the pump 34 is energized. Although there is no demand at the water outlet 32 during internal recirculation, a flow 42 is again developed in the main flowline 36, wherein heat generated in the heat exchanger 2 can be again added to the flow in the main flowline 36. The heat exchanger 2 may also be used in a water heating circuit without an internal recirculation flowline 64 or a water heating circuit including an external recirculation flowline (not depicted).

Figure 12:
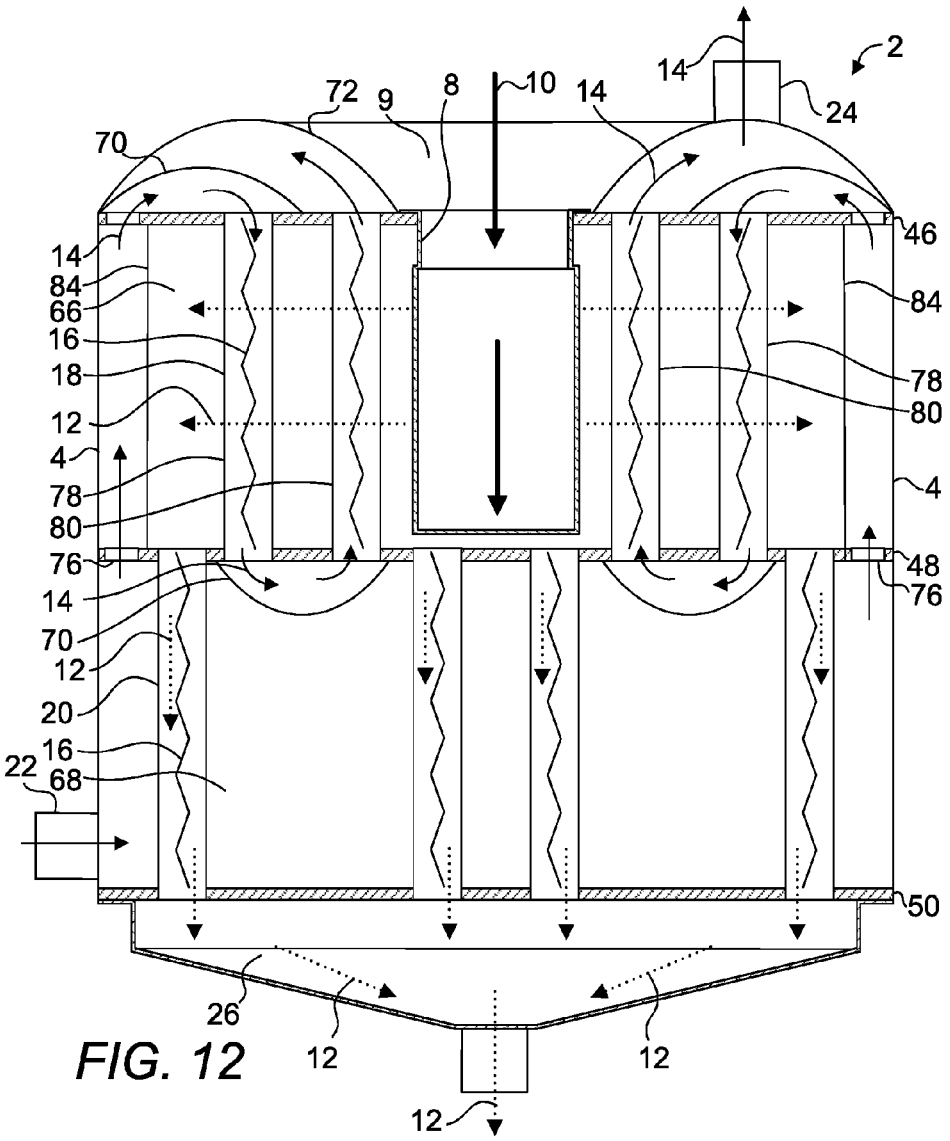
FIG. 12 depicts an alternative embodiment of the present invention.
Figure 13:
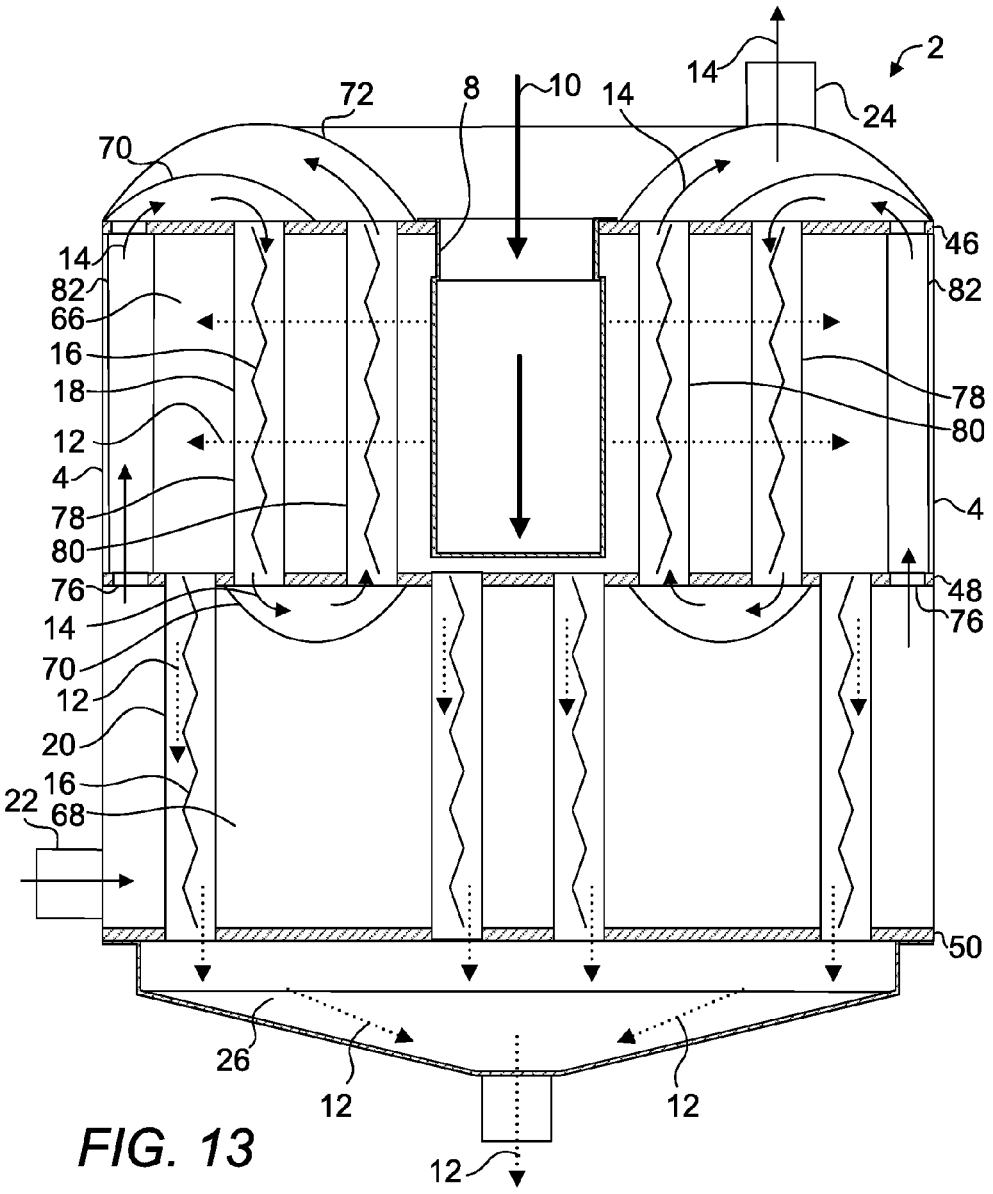
FIG. 13 depicts an alternative embodiment of the present invention.
Figure 14:
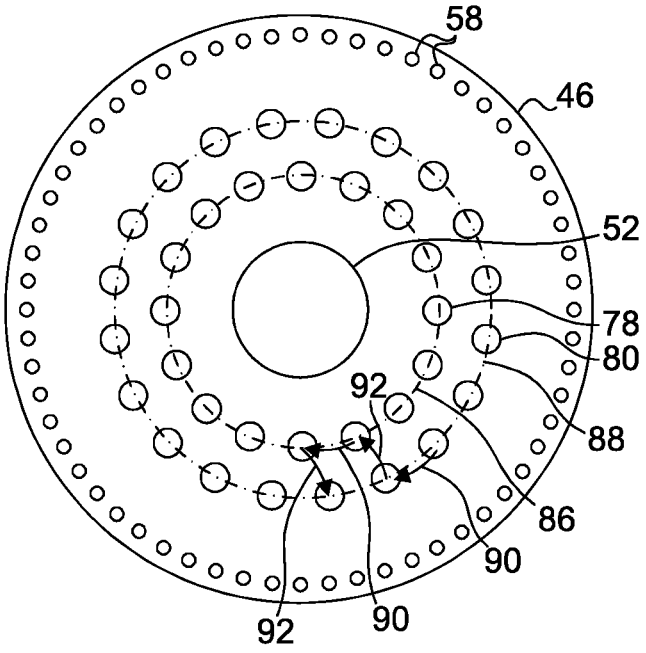
FIG. 14 depicts a partial alternative flow pattern in the water tubes of FIG. 13.

FIGS. 12, 13, 14 and 15 depict alternative embodiments of the present invention. In these embodiments, only sectioned portions of the heat exchanger are depicted for clarity. FIG. 12 depicts the use of inner manifolds 70 of semicircular profile to redirect water flow 14 more than once through the gas cavity 66 and staggering the outer and inner manifolds 72, 70 to further minimize heat loss through the top water jacket. In this embodiment, water flow 14 enters at water inlet 22 near the bottom of the water cavity 68 and exits through the water outlet 24 on the top of the outer manifold 72. Upon entering the heat exchanger 2, the water flow 14 is first directed upwardly, via a plurality of apertures through middle tube sheet 48, side water jacket 4 and then redirected downwardly using a first inner manifold 70 at the top tube sheet 46 through the gas cavity 66. The water flow 14 is then redirected upwardly by a second inner manifold 70 at the middle tube sheet 48 through the gas cavity 66 and exits through a the outer manifold 72. In one embodiment, the number and size of water tubes 80 disposed on the inner ring are configured such that the water flow 14 within them possesses sufficient speed to suitably receive heat from the water tubes 80. For instance, in order to prevent excessive heat build-up in water tubes 80 which can cause thermal stresses especially at joints between tube sheets 48, 46 and water tubes 80, a smaller number of water tubes 80 or smaller diameter water tubes 80 may be used to cause higher water flow 14 velocity (in maintaining flowrate) within water tubes 80, thereby causing higher rate of heat removal from the water tubes 80. Thermal stresses pose less challenge to water tubes 78 as water tubes 78 are disposed at a greater distance from the burner 8 than water tubes 80 and partially thermally shielded from the burner 8 by water tubes 80, thereby causing lower heat transfer rate to water tubes 78. Therefore, water tubes 78, disposed on the outer ring, may be configured in higher number and larger in diameter than water tubes 80 as the requirement to prevent excessive heat build-up in water tubes 78 is lower. FIG. 13 depicts essentially the same embodiment as FIG. 12 with the exception of the use of a plurality of outer tubes 82 to form a side liquid jacket. In FIG. 13, the inner wall 84 of the side liquid jacket has been eliminated but instead replaced by the use of a plurality of outer tubes 82 disposed in a ring pattern about the burner 8. The use of outer tubes 82 eliminate the need of a thick inner wall 84. Such use of outer tubes 82 may be alternatively applied to all other embodiments disclosed herein. FIG. 14 depicts a partial alternative flow pattern in the water tubes of FIG. 13. In this embodiment, water flow is configured to occur between water tubes disposed within a ring (86 or 88) as shown in part 90 as well as water tubes disposed across two rings 86, 88 as shown in part 92. It shall be appreciated, by those skilled in the art, that water flow within the gas cavity 66 may be configured in other equivalent manners provided that the flow penetrates the gas cavity 66 more than once.

Referring back to FIG. 12, the top water jacket 6 is configured in a semicircular profile, i.e., void of any flat portions on its external surface such that the top water jacket 6 may be constructed from the thinnest material possible and still maintaining sufficient structural strength. It shall be noted that a portion of the top water jacket 6 is configured such that it protrudes as far into the opening 9 of the top water jacket 6 which accommodates the burner 8 in order to maximize heat transfer from the burner 8 as well as from the top tube sheet 46 to the top water jacket 6.

Figure 15:
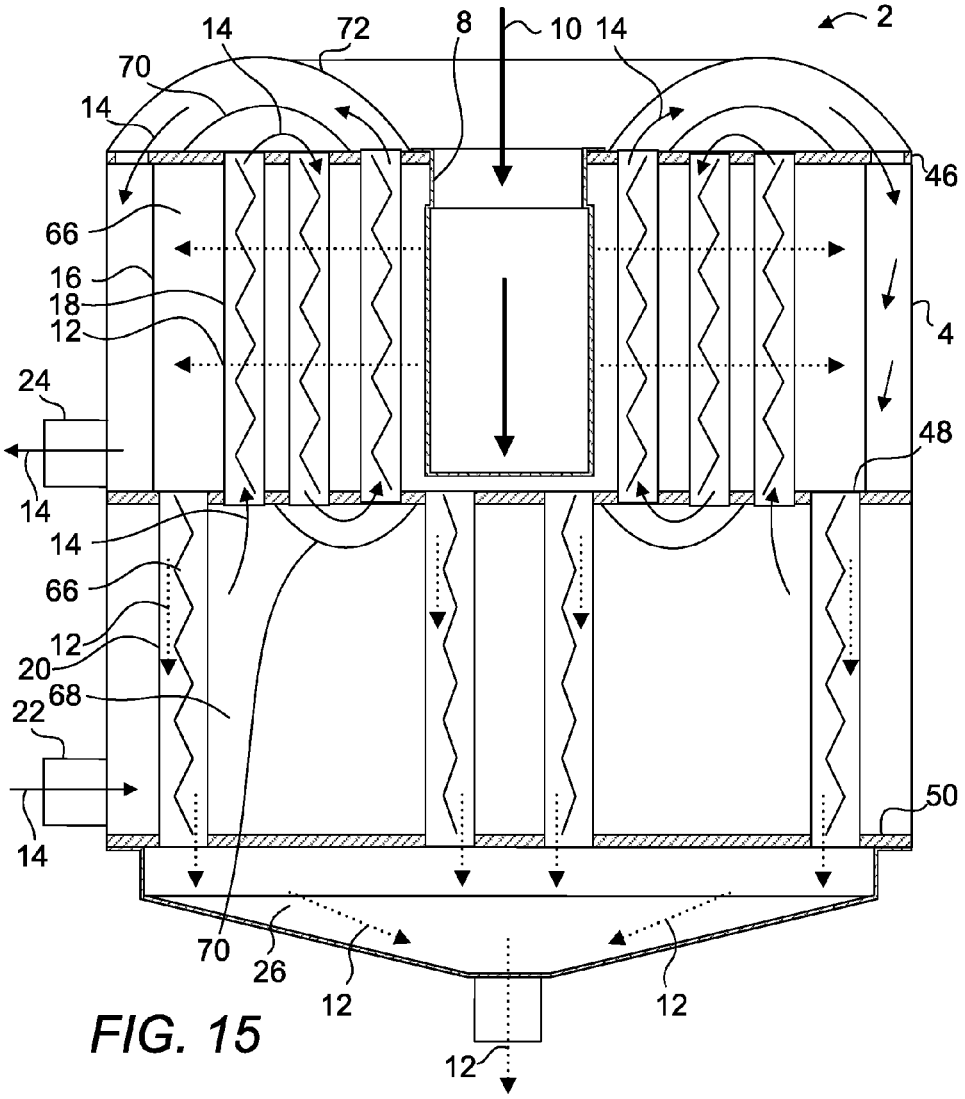
FIG. 15 depicts an alternative embodiment of the present invention.

FIG. 15 depicts another embodiment of the use of inner manifolds 70 of semicircular profile to redirect water flow 14 more than once through the gas cavity 66 and staggering the outer and inner manifolds 72, 70 to further minimize heat loss through the top water jacket. In this embodiment, water flow 14 enters at water inlet 22 near the bottom of the water cavity 68 and exits through the water outlet 24 disposed near the bottom of the gas cavity 66. Upon entering the heat exchanger 2, the water flow 14 is first directed upwardly through water tubes 18 at the middle tube sheet 48 and then redirected downwardly using a first inner manifold 70 at the top tube sheet 46 through the gas cavity 66. The water flow 14 is again redirected upwardly by a second inner manifold 70 at the middle tube sheet 48 through the gas cavity 66. At the top tube sheet 46, the water flow 14 is then redirected downwardly by a space defined by the outer and inner manifolds 72, 70 through the side water jacket and exits through the water outlet 24.

Figure 16:
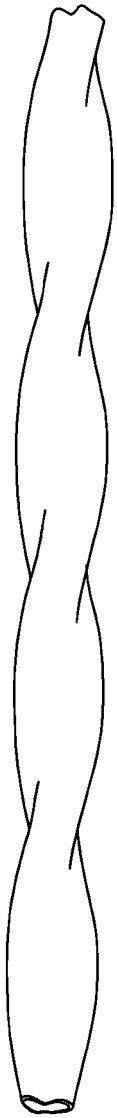
FIG. 16 depicts a partial front orthogonal view of a twisted tube according to the present invention.

FIG. 16 depicts a partial front orthogonal view of a twisted tube according to the present invention. A twisted tube may be formed by twisting a straight tube having a central longitudinal axis, i.e., by first securing each of the two ends and then causing rotational deformation about the central longitudinal axis. The resulting twisted tube possesses irregularities in the interior and exterior surfaces of the tube to increase turbulence of either in a flue gas or water flow inside or outside of the tube to enhance heat transfer. In yet another embodiment, a turbulator is first disposed within a straight tube prior to twisting the straight tube-turbulator combination to further enhance flow turbulence inside the tube.

Although the present heat exchanger is configured for use in a water heater, it is apparent that such heat exchanger may also be used to heat other liquids without undue experimentation.

It will be appreciated by those skilled in the art that while the invention has been described above in connection with particular embodiments the invention is not necessarily so limited and that numerous other embodiments, uses, modifications and departures from the embodiments, and uses may be made without departing from the inventive concepts.

We claim:

1. A heat exchanger (2) comprising:

(a) a liquid cavity (68) having a liquid inlet (22) for receiving a liquid flow (14);

(b) a gas cavity (66) configured for receiving a burner (8) substantially centrally disposed within said gas cavity (66), said gas cavity (66) is configured to be isolated from said liquid cavity (68) with a flat sheet (48), wherein said gas cavity (66) is disposed atop said liquid cavity (68);

(c) a plurality of liquid tubes (18) connecting said liquid cavity (68) through said gas cavity (66); and (d) a plurality of gas tubes (20) connecting said gas cavity (66) through said liquid cavity (68) to a gas exhaust (26) disposed below said liquid cavity (68), said gas exhaust (26) is configured to be isolated from said liquid cavity (68) with a flat sheet (50), wherein said liquid flow (14) is configured to flow from said liquid inlet (22) through said liquid cavity (68), said plurality of liquid tubes (18) to a liquid outlet (24) and said burner (8) is configured to produce direct heat and a flue gas flow (12) configured to flow from said gas cavity (66) through said plurality of gas tubes (20) to said gas exhaust (26) and heat transfer is caused from said direct heat and said flue gas flow (12) to said liquid flow (14).

2. The heat exchanger (2) of claim 1, further comprising a top liquid jacket (6) disposed atop said gas cavity (66), said gas cavity 66 is configured to be isolated from said too liquid jacket (6) with a flat sheet (46), wherein said top liquid jacket (6) connects said liquid flow (14) from said plurality of liquid tubes (18) to said liquid outlet (24).

3. The heat exchanger (2) of claim 2, further comprising a side liquid jacket (4) disposed around at least a portion of said gas cavity (66), wherein said side liquid jacket (4) connects said liquid flow (14) from said top liquid jacket (6) to said liquid outlet (24).

4. The heat exchanger (2) of claim 3, wherein said side liquid jacket (4) is comprised of at least one outer tube (82).

5. The heat exchanger (2) of claim 1, further comprising a side liquid jacket (4) disposed around at least a portion of said gas cavity (66) and at least a portion of said liquid cavity (68), wherein said side liquid jacket (4) connects said liquid flow (14) from said top liquid jacket (6) to said liquid outlet (24).

6. The heat exchanger (2) of claim 5, wherein said side liquid jacket (4) is comprised of at least one outer tube (82).

7. The heat exchanger (2) of claim 1, further comprising at least one turbulator (16) disposed within one of said plurality of liquid tubes (18) and said plurality of gas tubes (20).

8. The heat exchanger (2) of claim 1, wherein said plurality of gas tubes (20) is disposed at a greater radial distance from said burner (8) than the radial distance between said plurality of liquid tubes (18) and said burner (8).

9. The heat exchanger (2) of claim 8, wherein said plurality of gas tubes (20) is configured to extend into said gas cavity (66), said plurality of gas tubes (20) further comprises at least one slot (74) facing away from said burner (8).

10. The heat exchanger (2) of claim 1, wherein said plurality of liquid tubes (18) is configured to penetrate said gas cavity (66) more than once to increase exposure of said liquid flow (14) to said heat transfer.

11. The heat exchanger (2) of claim 1, wherein at least one of said plurality of liquid tubes (18) and said plurality of gas tubes (20) is a twisted tube.

12. A heat exchanger (2) comprising:

(a) a liquid cavity (68) having a liquid inlet (22) for receiving a liquid flow (14);

(b) a gas cavity (66) configured for receiving a burner (8) substantially centrally disposed within said gas cavity (66), said gas cavity (66) is configured to be isolated from said liquid cavity (68) with a flat sheet (48), wherein said gas cavity (66) is disposed atop said liquid cavity (68);

(c) a top liquid jacket (6) disposed atop said gas cavity (66);

(d) a plurality of liquid tubes (18) connecting said liquid cavity (68) through said gas cavity (66) to said top liquid jacket (6);

(e) a plurality of gas tubes (20) connecting said gas cavity (66) through said liquid cavity (68) to a gas exhaust (26) disposed below said liquid cavity (68), said gas exhaust (26) is configured to be isolated from said liquid cavity (68) with a flat sheet (50); and (f) a side liquid jacket (4) disposed around at least a portion of said gas cavity (66) and at least a portion of said liquid cavity (68), wherein said liquid flow (14) is configured to flow from said liquid inlet (22) through said liquid cavity (68), said plurality of liquid tubes (18), said top liquid jacket (6), said side liquid jacket (4) to a liquid outlet (24), said liquid flow is confined within a space delineated within said top liquid jacket (6) and said side liquid jacket (4) and said burner (8) is configured to produce direct heat and a flue gas flow (12) configured to flow from said gas cavity (66) through said plurality of gas tubes (20) to said gas exhaust (26) and heat transfer is caused from said direct heat and said flue gas flow (12) to said liquid flow (14).

13. The heat exchanger (2) of claim 12, wherein said side liquid jacket (4) is comprised of at least one outer tube (82).

14. The heat exchanger (2) of claim 12, further comprising at least one turbulator (16) disposed within one of said plurality of liquid tubes (18) and said plurality of gas tubes (20).

15. The heat exchanger (2) of claim 12, wherein said plurality of gas tubes (20) is disposed at a greater radial distance from said burner (8) than the radial distance between said plurality of liquid tubes (18) and said burner (8).

16. The heat exchanger (2) of claim 15, wherein said plurality of gas tubes (20) is configured to extend into said gas cavity (66), said plurality of gas tubes (20) further comprises at least one slot (74) facing away from said burner (8).

17. The heat exchanger (2) of claim 12, wherein said plurality of liquid tubes (18) is configured to penetrate said gas cavity (66) more than once to increase exposure of said liquid flow (14) to said heat transfer.

18. The heat exchanger (2) of claim 12, wherein at least one of said plurality of liquid tubes (18) and said plurality of gas tubes (20) is a twisted tube.

19. A heat exchanger (2) comprising:

(a) a liquid cavity (68) having a liquid inlet (22) for receiving a liquid flow (14);

(b) a gas cavity (66) configured for receiving a burner (8) substantially centrally disposed within said gas cavity (66), said gas cavity (66) is configured to be isolated from said liquid cavity (68) with a flat sheet (48), wherein said gas cavity (66) is disposed atop said liquid cavity (68);

(c) a side liquid jacket (4) disposed around at least a portion of said gas cavity (66);

(d) a top liquid jacket (6) disposed atop said gas cavity (66);

(e) a plurality of liquid tubes (18) connecting said side liquid jacket (4) through said gas cavity (66) to said top liquid jacket (6), wherein said plurality of liquid tubes (18) is configured to penetrate said gas cavity (66) more than once to increase exposure of said liquid flow (14) to said heat transfer; and (f) a plurality of gas tubes (20) connecting said gas cavity (66) through said liquid cavity (68) to a gas exhaust (26) disposed below said liquid cavity (68), said gas exhaust (26) is configured to be isolated from said liquid cavity (68) with a flat sheet (50), wherein said liquid flow (14) is configured to flow from said liquid cavity (68) through said side liquid jacket (4), said plurality of liquid tubes (18), said top liquid jacket (6) and a liquid outlet (24) disposed in said top liquid jacket (61), said liquid flow is confined within a space delineated within said top liquid jacket (6) and said side liquid jacket (4) and said burner (8) is configured to produce direct heat and a flue gas flow (12) configured to flow from said gas cavity (66) through said plurality of gas tubes (20) to said gas exhaust (26) and heat transfer is caused from said direct heat and said flue gas flow (12) to said liquid flow (14).

* * * * *